US005966154A

United States Patent [19]

DeBoer

[11] Patent Number: 5,966,154

[45] Date of Patent: Oct. 12, 1999

[54] GRAPHIC ARTS PRINTING PLATE PRODUCTION BY A CONTINUOUS JET DROP PRINTING WITH ASYMMETRIC HEATING DROP DEFLECTION

[75] Inventor: Charles D. DeBoer, Palmyra, N.Y.

[73] Assignee: Eastman Kodak Company, Rochester, N.Y.

[21] Appl. No.: 08/954,316

[22] Filed: Oct. 17, 1997

[51] Int. Cl.[6] ..... B41J 2/105; B41J 2/02

[52] U.S. Cl. ..... 347/82; 347/75

[58] Field of Search ..... 347/82, 75, 62, 347/54, 48

[56] References Cited

U.S. PATENT DOCUMENTS

| | | | |
|---|---|---|---|
| 1,941,001 | 12/1933 | Hansell . | |
| 3,373,437 | 3/1968 | Sweet et al. . | |
| 3,416,153 | 12/1968 | Hertz et al. . | |
| 3,705,043 | 12/1972 | Zabiak . | |
| 3,709,432 | 1/1973 | Robertson | 239/4 |
| 3,747,120 | 7/1973 | Stemme . | |
| 3,776,642 | 12/1973 | Anson et al. . | |
| 3,846,141 | 11/1974 | Ostergren et al. . | |
| 3,870,528 | 3/1975 | Edds et al. . | |
| 3,878,519 | 4/1975 | Eaton . | |
| 3,889,269 | 6/1975 | Meyer et al. . | |
| 3,903,034 | 9/1975 | Zabiak et al. . | |
| 4,003,312 | 1/1977 | Gunther . | |
| 4,303,924 | 12/1981 | Young, Jr. . | |
| 4,346,387 | 8/1982 | Hertz . | |
| 4,599,627 | 7/1986 | Vollert . | |
| 4,833,486 | 5/1989 | Zerillo | 101/450.1 |
| 4,847,630 | 7/1989 | Bhaskar et al. | 347/62 |
| 5,053,381 | 10/1991 | Chapman et al. . | |
| 5,168,288 | 12/1992 | Baek et al. . | |
| 5,466,653 | 11/1995 | Ma et al. . | |
| 5,466,658 | 11/1995 | Harrision et al. . | |
| 5,492,046 | 2/1996 | Jimenez . | |
| 5,495,803 | 3/1996 | Gerber et al. . | |
| 5,501,150 | 3/1996 | Leenders et al. . | |
| 5,511,477 | 4/1996 | Adler et al. . | |
| 5,543,177 | 8/1996 | Morrison et al. | 427/288 |
| 5,611,847 | 3/1997 | Guistina et al. . | |
| 5,679,139 | 10/1997 | McInerney et al. . | |
| 5,679,141 | 10/1997 | McInerney et al. . | |
| 5,679,142 | 10/1997 | McInerney et al. . | |
| 5,706,041 | 1/1998 | Kubby | 347/18 |

FOREIGN PATENT DOCUMENTS

| | | |
|---|---|---|
| 0 776 763 A1 | 6/1997 | European Pat. Off. . |
| WO 94/01191 | 1/1994 | WIPO . |

OTHER PUBLICATIONS

Patent Abstract of Japan JP 53015905 A, Tokyo Ohka Kogyo Co Ltd, dated Feb. 14, 1978.

Patent Abstract of Japan JP 56105960 A, Fuji Photo Film Co Ltd, dated Aug. 22, 1981.

Patent Abstract of Japan JP 6225081 A, Kumatoriya Akihiko et al, dated Aug. 12, 1994.

*Primary Examiner*—N. Le
*Assistant Examiner*—Thien Tran
*Attorney, Agent, or Firm*—Milton S. Sales

[57] ABSTRACT

A graphic arts printing apparatus includes a delivery channel for hydrophobic liquid; a source of pressurized hydrophobic liquid communicating with the delivery channel; a nozzle bore which opens into the delivery channel to establish a continuous flow of hydrophobic liquid in a stream; and a droplet generator which causes the stream to break up into a plurality of droplets at a position spaced from the stream generator. The droplet generator includes a heater having a selectively-actuated section associated with only a portion of the nozzle bore perimeter, whereby actuation of the heater section produces an asymmetric application of heat to the stream to control the direction of the stream between a print direction and a non-print direction.

10 Claims, 4 Drawing Sheets

GRAPHIC ARTS PRINTING PLATE PRODUCTION BY A CONTINUOUS JET DROP PRINTING WITH ASYMMETRIC HEATING DROP DEFLECTION

CROSS REFERENCE TO RELATED APPLICATIONS

Reference is made to commonly assigned, co-pending U.S. patent applications Ser. No. 09/090,581 entitled PRINTING PLATE AND METHOD OF PREPARATION filed Jun. 4, 1998 in the name of M. Simons; Ser. No. 08/955,562 entitled CONTINUOUS INK JET PRINTER WITH ELECTROSTATIC DROP DEFLECTION filed concurrently herewith in the names of J. Chwalek and C. Anagnostopoulos; Ser. No. 08/954,317 entitled CONTINUOUS INK JET PRINTER WITH ASYMMETRIC HEATING DROP DEFLECTION filed concurrently herewith in the names of J. Chwalek, D. Jeanmaire and C. Anagnostopoulos; Ser. No. 08/790,131 entitled HEAT TRANSFERRING INKJET INK IMAGES filed Jan. 29, 1997 in the names of J. Bishop, M. Simons and M. Brick; and Ser. No. 08/764,379 entitled PIGMENTED INKJET INKS CONTAINING PHOSPHATED ESTER DERIVATIVES filed on Dec. 13, 1996 in the name of T. Martin.

FIELD OF THE INVENTION

This invention relates generally to the field of graphic arts media such as color proofs, monochrome and color separation photomask films, offset lithographic printing plates, of both the conventional and waterless variety, gravure printing cylinders, silk screens for silk screen printing, flexographic direct printing plates, and direct write reusable printing image cylinders for offset printing.

BACKGROUND OF THE INVENTION

Printing plates suitable for offset lithographic printing are known which comprise a support having a surface having hydrophilic non-image areas and hydrophobic ink-receptive image areas. The art of lithographic printing is based upon the immiscibility of oil and water, wherein oily ink is preferentially retained by the image area and water or fountain solution is preferentially retained by non-image areas.

Ink jet printing mechanisms can be categorized as either continuous ink jet or drop-on-demand ink jet. Graphic arts require small dots for acceptable resolution, and drop-on-demand ink jet printers are at present incapable of producing drops sufficiently small for the graphic arts industry. Continuous ink jet printing, which can produce acceptably small drops, dates back to at least 1929. See U.S. Pat. No. 1,941,001 to Hansell.

U.S. Pat. No. 4,833,486 describes an apparatus for the production of lithographic printing plates by melting a solid hydrophobic ink and spraying droplets of the melted ink onto the plate in a pattern corresponding to the image with an ink jet head.

U.S. Pat. No. 5,501,150 describes a process for the manufacture of a lithographic printing plate by image-wise projection of droplets of liquid onto a hydrophilic surface thus to bring together a reducible silver compound, a reducing agent for the silver compound, and physical development nuclei to catalyze the reduction of the silver compound to silver metal. The silver image is hydrophobized to produce the printing plate.

U.S. Pat. No. 4,303,924 describes a ink jet printing process utilizing a radiation curable ink composition comprising an ethylenically unsaturated material, a reactive synergist, a dye colorant and an oil soluble salt for conductivity.

U.S. Pat. No. 5,511,477 claims the method of preparing photopolymer relief type printing plates such as flexographic printing plates by use of a radiation cured photopolymeric ink containing ferromagnetic powder for conductivity.

U.S. Pat. No. 5,495,803 discloses a method of forming a graphic arts photomask, also known as a color separation image, by ink jet printing. The photomask is then used to expose a sensitized lithographic printing plate.

JP-A-53015905 discloses the preparation of a printing plate by ink-jetting an alcohol-soluble resin in an organic solvent onto an aluminum plate.

JP-A-56105960 describes the formation of a printing plate by ink-jetting an ink capable of forming an oleophilic surface, which ink contains a hardening substance such as an epoxide or photo-hardening substance onto a hydrophilic substrate.

EP-776763-A1 describes a method for producing a lithographic printing plate by ink jet printing of two reactive inks which combine to form a polymeric resin which forms the ink accepting part of the lithographic printing plate image.

Kokai 62-25081 describes a lithographic printing plate made by ink-jetting an oleophilic liquid onto an aluminum plate.

WO 94/1191 describes in ink jet apparatus for the production of lithographic printing plates.

U.S. Pat. No. 4,599,627 describes an apparatus for ink jet printing which jets two different inks onto the same spot, using electrostatic deflection of conducting inks to control the printing.

U.S. Pat. No. 5,466,658 describes a method for preparing relief images (flexographic printing plates) by ink-jetting a reagent that reacts with a polymer on a substrate to render it insoluble in the subsequent processing solution.

U.S. Pat. No. 5,168,288 describes a laser thermal color proofing system, wherein absorption of laser light heats a dye laser thus causing the dye to be transferred to a receiver. Such a system, while effective for producing proofs, is expensive because of the cost of preparing donor sheets.

U.S. Pat. No. 5,492,046 describes a method for preparing a lithographic printing plate by laser thermal exposure of the sensitized plate followed by solution processing. While effective, such systems are expensive because of the high cost of the multiple high power lasers that are required.

Inks for high speed ink jet printers must have a number of special characteristics. Typically, water-based inks have been used because of their conductivity and viscosity range. Thus, for use in a conventional ink jet printer the ink must be electrically conductive, having a resistivity below about 5000 ohm-cm and preferably below about 500 ohm-cm. For good runability through small orifices water-based inks generally have a viscosity in the range between about one and fifteen centipoise at 25° C.

Additionally, the ink must be stable over a long period of time, compatible with the materials comprising the orifice plate and ink manifold, free of living organisms, and functional after printing. The required functional characteristics after printing are: smear resistance after printing, fast drying on paper, and waterproof when dry. Examples of different types of water-based ink jet printing inks are found in U.S. Pat. No. 3,903,034; No. 3,889,269; No. 3,870,528; No. 3,846,141; No. 3,776,642; and No. 3,705,043.

Water-based inks in general can be said to have the following problems:

(1) They require a large amount of energy to dry after printing.

(2) Large printed areas on paper usually cockle because of the amount of water present.

(3) The printed images are sensitive to wet and dry rub.

(4) The compositions of the ink usually require an anti-bacterial preservative to minimize the growth of bacteria in the ink.

(5) The inks tend to dry out on the tip of the orifice resulting in clogging.

Some of these problems may be overcome by the use of polar, conductive organic solvent based ink formulations. However, the use of non-polar organic solvents is generally precluded by their lack of electrical conductivity.

Scitex has demonstrated, at the Print '97 show in Chicago, an Iris jet drop printer with a special liquid writing on grained, anodized aluminum plates to make an offset lithographic printing plate. They showed the press run from such plates. However, the Iris jet drop printer is slow, because it has a limited number of nozzles. Adding more nozzles is expensive. In addition, the use of the electrostatic deflection system in the Iris jet drop printer limits the kinds of liquids that can be used.

U.S. Pat. No. 3,373,437, which issued to Sweet et al. in 1967, discloses an array of continuous ink jet nozzles wherein ink drops to be printed are selectively charged and deflected towards the printing plate. This technique is known as binary deflection continuous ink jet, and is used by several manufacturers, including Elmjet and Scitex.

U.S. Pat. No. 3,416,153, which issued to Hertz et al. in 1966, discloses a method of achieving variable optical density of printed spots in continuous ink jet printing using the electrostatic dispersion of a charged drop stream to modulate the number of droplets which pass through a small aperture. This technique is used in ink jet printers manufactured by Iris.

U.S. Pat. No. 3,878,519, which issued to Eaton in 1974, discloses a method and apparatus for synchronizing droplet formation in a liquid stream using electrostatic deflection by a charging tunnel and deflection plates.

U.S. Pat. No. 4,346,387, which issued to Hertz in 1982 discloses a method and apparatus for controlling the electric charge on droplets formed by the breaking up of a pressurized liquid stream at a drop formation point located within the electric field having an electric potential gradient. Drop formation is effected at a point in the field corresponding to the desired predetermined charge to be placed on the droplets at the point of their formation. In addition to charging tunnels, deflection plates are used to actually deflect drops.

Conventional continuous ink jet utilizes electrostatic charging tunnels that are placed close to the point where the drops are formed in a stream. In this manner individual drops may be charged. The charged drops may be deflected downstream by the presence of deflector plates that have a large potential difference between them. A gutter (sometimes referred to as a "catcher") may be used to intercept the charged drops, while the uncharged drops are free to strike the printing plate. In the current invention, the electrostatic charging tunnels are unnecessary.

It would be desirable to have an jet drop printing process to prepare graphic arts media of all kinds economically, and with high speed, without the limitations of having to use electrically conductive liquids.

DISCLOSURE OF THE INVENTION

It is an object of the present invention to provide a high speed apparatus and method for graphic arts media utilizing a continuous jet drop printing method whereby drop formation and deflection may occur at high repetition.

It is another object of the present invention to provide an apparatus and method of continuous jet drop printing for graphic arts media with drop deflection means which can be integrated with the printhead utilizing the advantages of silicon processing technology offering low cost, high volume methods of manufacture.

It is still another object of the present invention to provide an apparatus and method for continuous jet drop printing of graphic arts media that does not require electrostatic charging tunnels.

It is yet another object of the present invention to provide a method for the preparation of graphic arts media by continuous jet drop printing without the restriction of using conductive liquids.

According to a feature of the present invention, a graphic arts printing apparatus is provided for image-wise applying drops of hydrophobic liquid to a lithographic printing plate by way of a jet drop printer in which a continuous stream of hydrophobic liquid is emitted from a nozzle. The apparatus includes a stream generator which establishes a continuous flow of hydrophobic liquid in a stream. The stream breaks up into a plurality of droplets at a position spaced from the stream generator. A stream deflector adjacent to the stream between the stream generator and the position whereat the stream breaks up into droplets controls the direction of the stream between a print direction and a non-print direction.

According to another feature of the present invention, the graphic arts printing apparatus includes a droplet generator which causes the stream to break up into a plurality of droplets at a spaced position from the stream generator.

According to still another feature of the present invention, the graphic arts printing apparatus includes a delivery channel for hydrophobic liquid; a source of pressurized hydrophobic liquid communicating with the delivery channel; a nozzle bore which opens into the delivery channel to establish a continuous flow of hydrophobic liquid in a stream; and a droplet generator which causes the stream to break up into a plurality of droplets at a position spaced from the stream generator, the droplet generator including a heater having a selectively-actuated section associated with only a portion of the nozzle bore perimeter, whereby actuation of the heater section produces an asymmetric application of heat to the stream to control the direction of the stream between a print direction and a non-print direction.

According to yet another feature of the present invention, process is provided for controlling hydrophobic liquid in a continuous jet drop graphics arts printer in which a continuous stream of hydrophobic liquid is emitted from a nozzle. The process includes establishing a continuous flow of hydrophobic liquid in a stream which breaks up into a plurality of droplets at a position spaced from the nozzle; and deflecting the stream before the position whereat the stream breaks up into droplets to thereby control the direction of the stream between a lithographic printing plate and a non-print direction.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 2(*b*) shows a top view of the nozzle with asymmetric heating deflection.

DETAILED DESCRIPTION OF THE INVENTION

The present description will be directed in particular to elements forming part of, or cooperating more directly with, apparatus and method in accordance with the present invention. It is to be understood that elements not specifically shown or described may take various forms well known to those skilled in the art.

Figure 1:
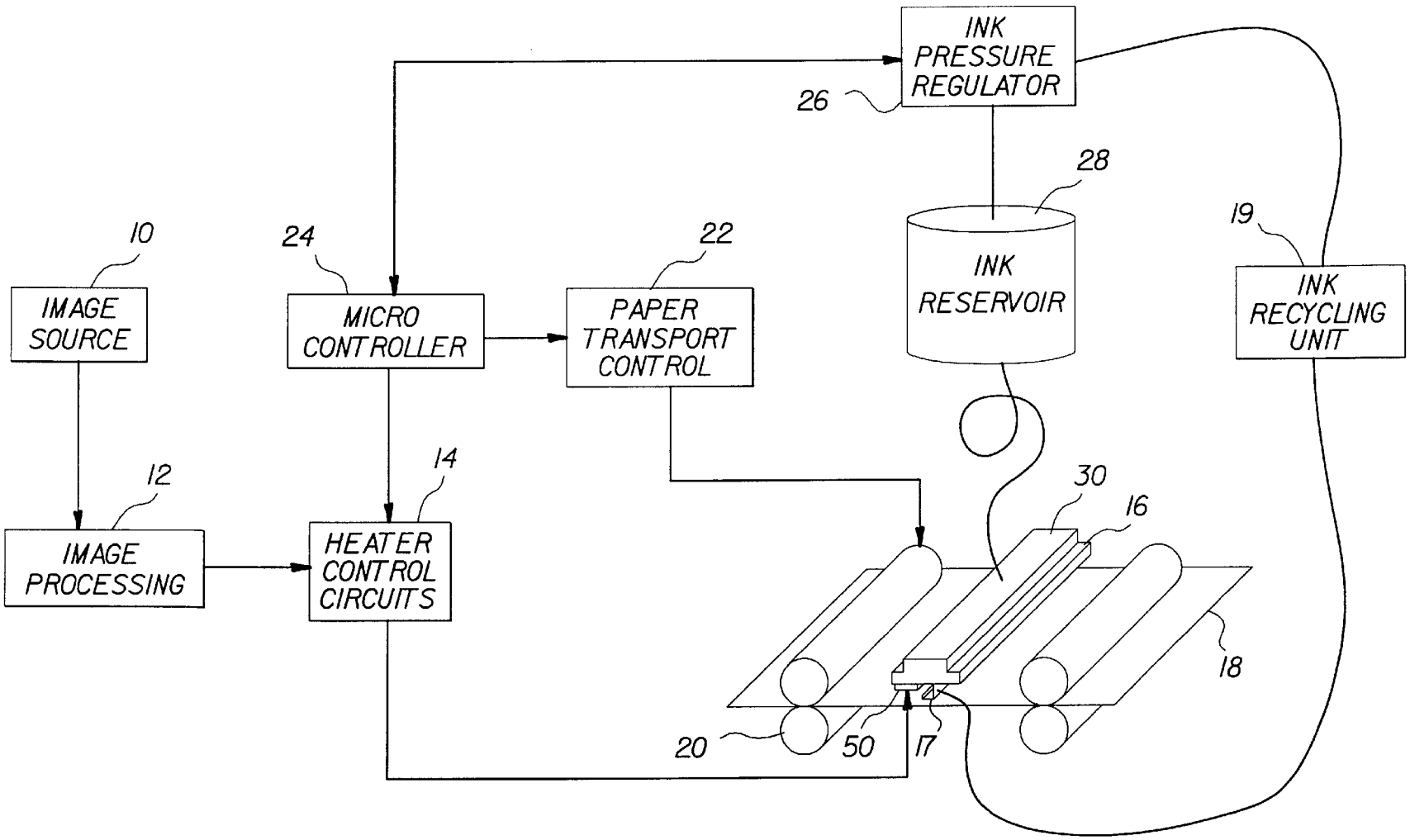
FIG. 1 shows a simplified block schematic diagram of one exemplary printing apparatus according to the present invention.

Referring to FIG. 1, a continuous jet drop printer system includes an image source 10 such as a scanner or computer which provides raster image data, outline image data in the form of a page description language, or other forms of digital image data. This image data is converted to half-toned bitmap image data by an image processing unit 12 which also stores the image data in memory. A plurality of heater control circuits 14 read data from the image memory and apply time-varying electrical pulses to a set of nozzle heaters 50 that are part of a printhead 16. These pulses are applied at an appropriate time, and to the appropriate nozzle, so that drops formed from a continuous flow of hydrophobic liquid in a stream will form spots on a printing plate 18 in the appropriate position designated by the data in the image memory.

Printing plate 18 is moved relative to printhead 16 by a printing plate transport system 20, which is electronically controlled by a printing plate transport control system 22, and which in turn is controlled by a micro-controller 24. The printing plate transport system shown in FIG. 1 is a schematic only, and many different mechanical configurations are possible. For example, a transfer roller could be used as printing plate transport system 20 to facilitate transfer of the ink drops to printing plate 18. Such transfer roller technology is well known in the art. In the case of page width printheads, it is most convenient to move printing plate 18 past a stationary printhead. However, in the case of scanning print systems, it is usually most convenient to move the printhead along one axis (the sub-scanning direction) and the printing plate along an orthogonal axis (the main scanning direction) in a relative raster motion.

Hydrophobic liquid is contained in an ink reservoir 28 under pressure. In the non-printing state, drops are unable to reach printing plate 18 due to a gutter 17 that blocks the stream and which may allow a portion of the liquid to be recycled by a recycling unit 19. The recycling unit reconditions the liquid and feeds it back to reservoir 28. Such recycling units are well known in the art. The pressure suitable for optimal operation will depend on a number of factors, including geometry and thermal properties of the nozzles and thermal properties of the liquid. A constant pressure can be achieved by applying pressure to reservoir 28 under the control of pressure regulator 26.

The liquid is distributed to the back surface of printhead 16 by a channel device 30. The liquid preferably flows through slots and/or holes etched through a silicon substrate of printhead 16 to its front surface, where a plurality of nozzles and heaters are situated. With printhead 16 fabricated from silicon, it is possible to integrate heater control circuits 14 with the printhead.

Figure 2A:
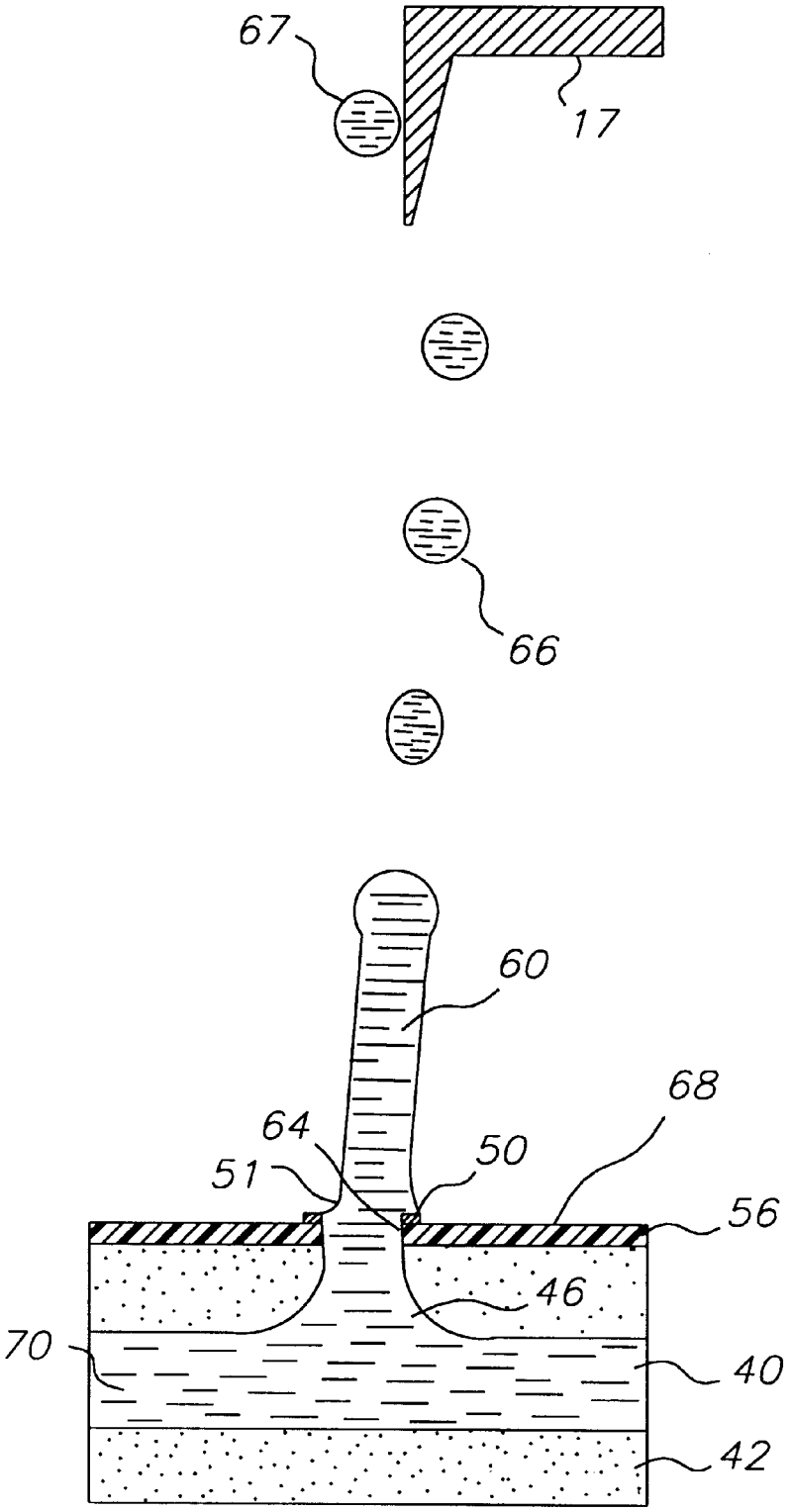
FIG. 2(*a*) shows a cross section of a nozzle with asymmetric heating deflection.
Figure 2B:
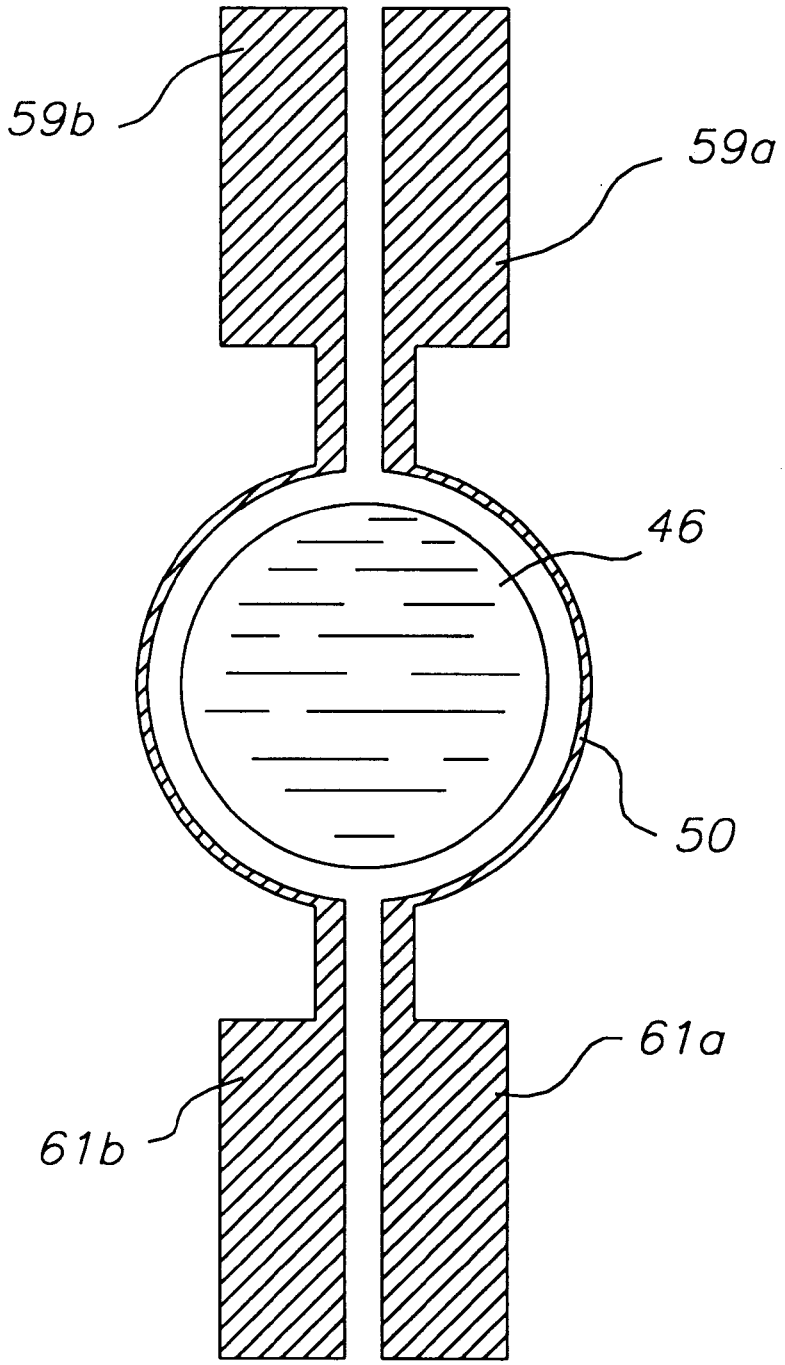

FIG. 2(*a*) is a cross-sectional view of one nozzle tip of an array of such tips that form continuous jet drop printhead 16 of FIG. 1 according to a preferred embodiment of the present invention. A delivery channel 40, along with a plurality of nozzle bores 46 are etched in a substrate 42, which is silicon in this example. Delivery channel 40 and nozzle bores 46 may be formed by anisotropic wet etching of silicon, using a $p^+$ etch stop layer to form the nozzle bores. Liquid 70 in delivery channel 40 is pressurized above atmospheric pressure, and forms a stream 60. At a distance above nozzle bore 46, stream 60 breaks into a plurality of drops 66 due to heat supplied by a heater 50.

Referring to FIG. 2(*b*), the heater has two sections, each covering approximately one-half of the nozzle perimeter. Power connections 72*a*, 72*b* and ground connections 74*a*, 74*b* from the drive circuitry to heater annulus 50 are also shown. Stream 60 may be deflected by an asymmetric application of heat by supplying electrical current to one, but not both, of the heater sections. This technology is distinct from that of prior systems of electrostatic continuous stream deflection printers, which rely upon deflection of charged drops previously separated from their respective streams. With stream 60 being deflected, drops 66 may be blocked from reaching printing plate 18 by a cut-off device such as gutter 17. In an alternate printing scheme, gutter 17 may be placed to block undeflected drops 67 so that deflected drops 66 will be allowed to reach printing plate 18.

The heater was made of polysilicon doped at a level of about thirty ohms/square, although other resistive heater material could be used. Heater 50 is separated from substrate 42 by thermal and electrical insulating layers 56 to minimize heat loss to the substrate. The nozzle bore may be etched allowing the nozzle exit orifice to be defined by insulating layers 56. The layers in contact with the liquid can be passivated with a thin film layer 64 for protection.

Figure 3:
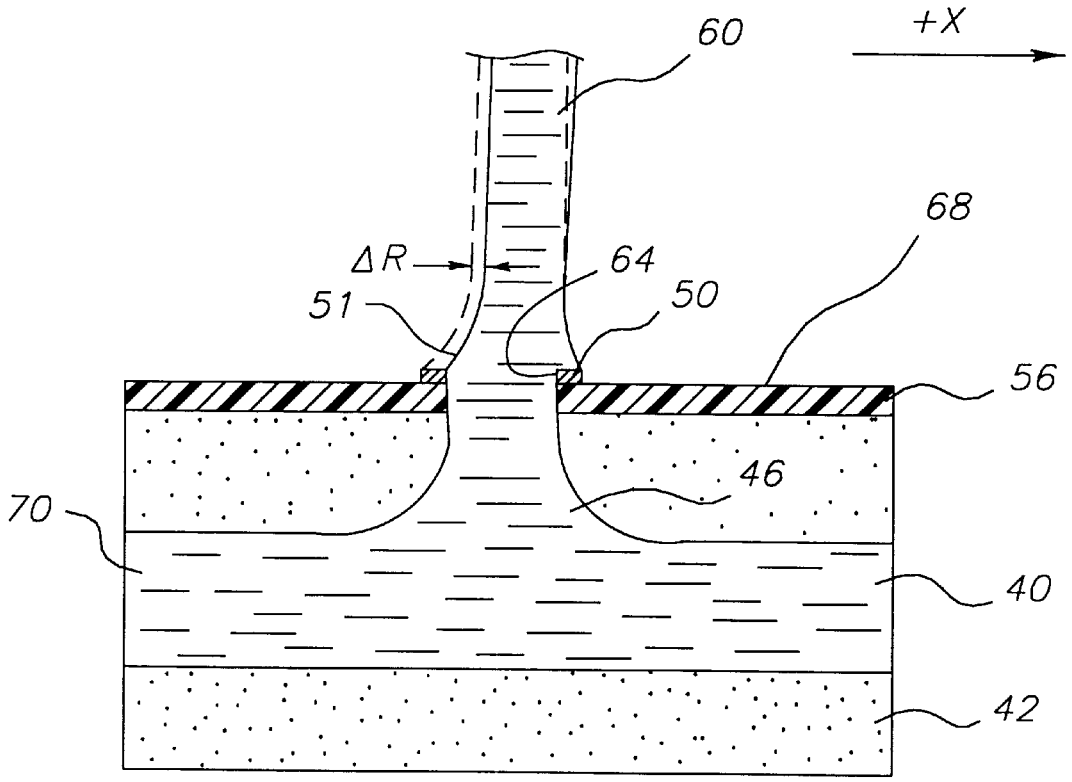
FIG. 3 is an enlarged cross section view of the nozzle with asymmetric heating deflection.

FIG. 3 is an enlarged view of the nozzle area. A meniscus 51 is formed where the liquid stream makes contact with the heater edges. When an electrical pulse is supplied to one of the sections of heater 50 (the left-hand side in FIG. 3), the contact line that is initially on the outside edge of the heater (illustrated by the dotted line) is moved inwards toward the inside edge of the heater (illustrated by the solid line). The other side of the stream (the right-hand side in FIG. 3) stays pinned to the non-activated heater. The effect of the inward moving contact line is to deflect the stream in a direction away from the active heater section (left to right in FIG. 3 or in the +x direction). At some time after the electrical pulse ends, the contact line returns toward the inside edge of the heater.

In this example, the nozzle is of cylindrical form, with the heater section covering approximately one-half the nozzle perimeter. By increasing the heater width, a larger change in radius and hence deflection is possible up to the point where meniscus 51 in the non-heated state (dotted line in FIG. 3) cannot wet to the outside edge of heater 50. Alternatively, heater 50 may be positioned further away from the edge of nozzle bore 46, resulting in a larger distance (for the same heater width) to the outside edge of heater 50. This distance may range from approximately 0.1 $\mu$m to approximately 3.0 $\mu$m. It is preferred that the inside edge of heater 50 be close to the edge of nozzle bore 46 as shown in FIG. 3. The optimal distance from the edge of nozzle bore 46 to the outside edge of the heater will depend on a number of factors including the surface properties of heater 50, the pressure applied to the liquid, and the thermal properties of the ink.

Heater control circuit 14 supplies electrical power to the heater as shown in FIG. 2(*a*). The time duration for optimal operation will depend on the geometry and thermal properties of the nozzles, the pressure applied to the liquid, and the thermal properties of the liquid. It is recognized that minor experimentation may be necessary to achieve the optimal conditions for a given geometry and liquid.

Deflection can occur by applying electrical power to one or both heaters causing an asymmetric heating condition. This results in deflection of the drop corresponding to this pulse. The details of the application of electrical pulses to the heater, the geometry's and materials of construction of the jet drop print heads of this invention are more fully described in the above mentioned cross-referenced applications.

Inks for inkjet printing for color proofing commonly comprise a colorant in water. Examples of such inks may be found is U.S. Pat. No. 5,611,847 to Gustina et al. Inks may also be found in U.S. Pat. Nos. 5,679,139; 5,679,141 and 5,679,142 which all issued on Oct. 21, 1997 to McInerney et al, and in U.S. patent application Ser. No. 08/790,131 filed on Jan. 29, 1997 by Bishop, Simons and Brick, and in U.S. patent application Ser. No. 08/764,379 filed on Dec. 13, 1996 by Martin. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. Other inks may include dyes dissolved in solvents. Examples of such dyes are found in U.S. Pat. No. 5,053,381, hereby incorporated by reference. Solvents for such dyes may be relatively non-polar solvents such as methy isobutyl ketone, methyl ethyl ketone, acetone, ethyl or butyl acetate, and toluene.

The jet drop printing apparatus of this invention can also be used to prepare the printing plate, by using a hydrophobic liquid printed onto a hydrophilic printing plate support. The hydrophobic liquid prints areas of the image which will attract the lithographic printing ink on the press, while the background hydrophilic areas, when wet with the fountain solution of the press, will repel the lithographic printing ink, thus providing the lithographic printing differentiation of the image areas on the press. Liquids for this purpose may be hydrophobic melted wax, radiation curable hydrophobic resins, or chemicals that react to provide a hydrophobic surface. They may contain a colorant for the convenience of the press operator, so the image to be lithographically printed is visible. Photomasks or color separations may also be printed by the method of this invention. In this case a support which is transparent to blue and ultra-violet radiation is printed with an ink which is opaque to blue and ultra-violet radiation. The photomask is then overlaid on a pre-sensitized printing plate and exposed to an intense light source such as a mercury arc to expose the desired areas of the plate. The plate is then processed to remove the non-image areas and mounted on the press for the printing run. Flexographic printing plates may also be prepared by the jet drop printing method of this invention, either by printing an ultra-violet and blue masking image over the plate, or by printing a chemical reagent that can modify the processing characteristics of the flexographic plate. Similarly, silk screens can be made, again by a masking ink or by a resin ink which will fill the pores of the screen upon drying. Finally, printing cylinders, either gravure of offset lithographic, may be imaged directly by the jet drop printing apparatus of this invention, using the liquids mentioned above.

The invention has been described in detail with particular reference to preferred embodiments thereof, but it will be understood that variations and modifications can be effected within the spirit and scope of the invention.

What is claimed is:

1. A graphic arts printing apparatus for image-wise applying drops of hydrophobic liquid to a lithographic printing plate by way of a jet drop printer in which a continuous stream of hydrophobic liquid is emitted from a nozzle; said apparatus comprising:

a delivery channel for hydrophobic liquid;

a source of pressurized hydrophobic liquid communicating with the delivery channel;

a nozzle bore which opens into the delivery channel to establish a continuous flow of hydrophobic liquid in a stream, the nozzle bore defining a nozzle bore perimeter; and a droplet generator which causes the stream to break up into a plurality of droplets at a position spaced from the stream generator, said droplet generator including a heater having a selectively-actuated section associated with only a portion of the nozzle bore perimeter, whereby actuation of the heater section produces an asymmetric application of heat to the stream to control the direction of the stream between a print direction and a non-print direction.

2. A graphic arts printing apparatus as set forth in claim 1, wherein the hydrophobic liquid has an electrical conductivity below about 5000 ohm-cm.

3. A graphic arts printing apparatus as set forth in claim 1, further comprising a gutter in the path of droplets traveling in only said non-print direction.

4. A graphic arts printing apparatus for image-wise applying drops of hydrophobic liquid to a lithographic printing plate by way of a jet drop printer in which a continuous stream of hydrophobic liquid is emitted from a nozzle; said apparatus comprising:

a delivery channel for hydrophobic liquid;

a source of pressurized hydrophobic liquid communicating with the delivery channel;

a nozzle bore which opens into the delivery channel to establish a continuous flow of hydrophobic liquid in a stream, the nozzle bore defining a nozzle bore perimeter; and a droplet generator which causes the stream to break up into a plurality of droplets at a position spaced from the stream generator, said droplet generator including a heater having a selectively-actuated section associated with only a portion of the nozzle bore perimeter, whereby actuation of the heater section produces an asymmetric application of heat to the stream to control the direction of the stream between a print direction and a non-print direction, wherein said heater has a two selectively-actuated sections which are independently actuated and positioned along respectively different portions of the nozzle bore perimeter, whereby selective actuation of the heater sections produces an asymmetric application of heat to the stream to control the direction of the stream between a print direction and a non-print direction.

5. A process for controlling hydrophobic liquid in a continuous jet drop graphics arts printer in which a continuous stream of hydrophobic liquid is emitted from a nozzle; said process comprising the steps of:

establishing a continuous flow of hydrophobic liquid in a stream which breaks up into a plurality of droplets at a position spaced from the stream generator, and asymmetrically applying heat to the stream before the position whereat the stream breaks up into droplets to thereby control the direction of the stream between a lithographic printing plate and a non-print direction.

6. The process as set forth in claim 5, wherein the step of establishing continuous flow of hydrophobic liquid in a stream comprises:

providing a delivery channel;

providing a source of hydrophobic liquid communicating with the delivery channel;

pressurizing the hydrophobic liquid in the delivery channel above atmospheric pressure; and providing a nozzle bore opening into the delivery channel.

7. The process as set forth in claim 5, further comprising providing a gutter in the path of hydrophobic liquid droplets traveling in said non-print direction.

8. A process for controlling hydrophobic liquid in a continuous jet drop graphics arts printer in which a continuous stream of hydrophobic liquid is emitted from a nozzle; said process comprising the steps of:

establishing a continuous flow of hydrophobic liquid in a stream;

causing the stream to break up into a plurality of droplets at a position spaced from the nozzle; and asymmetrically applying heat to the stream before the position whereat the stream breaks up into droplets to thereby control the direction of the stream between a lithographic printing plate and a non-print direction.

9. The process as set forth in claim 8, wherein the step of establishing a continuous flow of hydrophobic liquid in a stream comprises:

providing a delivery channel;

providing a source of hydrophobic liquid communicating with the delivery channel;

pressurizing the hydrophobic liquid in the delivery channel above atmospheric pressure; and providing a nozzle bore opening into the delivery channel.

10. The process as set forth in claim 8, further comprising providing a gutter in the path of droplets traveling in said non-print direction.

* * * * *